US005645186A

United States Patent [19]

Powers et al.

[11] Patent Number: 5,645,186

[45] Date of Patent: Jul. 8, 1997

[54] TRASH CONTAINER WITH LINER SECURING DEVICE

[76] Inventors: Robert W. Powers; Leigh McIntosh Powers, both of 442 N. Stewart, North Liberty, Iowa 52317

[21] Appl. No.: 730,113

[22] Filed: Oct. 15, 1996

[51] Int. Cl.[6] ..... B65D 25/16

[52] U.S. Cl. ..... 220/404

[58] Field of Search ..... 220/404, 353, 220/352, 356, 908

[56] References Cited

U.S. PATENT DOCUMENTS 4,923,087 5/1990 Burrows ..... 220/404
4,925,056 5/1990 McCoig .
5,028,022 7/1991 Metcalf .
5,090,585 2/1992 Power .
5,100,087 3/1992 Ashby .
5,419,452 5/1995 Mueller et al. .
5,419,453 5/1995 Lochridge .
5,425,469 6/1995 Freedland ..... 220/404
5,476,187 12/1995 Marisco ..... 220/404

*Primary Examiner*—Joseph M. Moy
*Attorney, Agent, or Firm*—Allan L. Harms

[57] ABSTRACT

An improved trash container useful for receiving a container liner and having clasps to grasp the edges of the liner to prevent the liner from falling into the container. The clasps may be integrally formed on the container or mounted to the container by adhesive or mechanical means.

20 Claims, 3 Drawing Sheets

TRASH CONTAINER WITH LINER SECURING DEVICE

BACKGROUND OF THE INVENTION

This invention pertains to trash containers which may be lined with thin-walled plastic liners and in particular to trash containers having means to prevent the plastic liners from falling into the trash containers.

Householders frequently use trash can liners to line trash cans, bins, wastebaskets, or the like in order to provide a disposable bag useful to draw the trash from the container. The use of a plastic liner serves to keep the inside of the trash container clean and is therefore desirable. Frequently consumers have a supply of flexible thin-walled plastic bags which are provided by retailers to carry purchased merchandise. These can also be reused as trash can liners.

Because the plastic bags or trash can liners are quite flexible, they tend to slip from the container rim and fall into the trash container when trash is placed in the container, particularly if the trash can liner is smaller than the volume of the trash container itself.

Various devices have been developed to attempt to provide a solution to the problem of the liner or bag falling into the trash container when trash is added. For example, U.S. Pat. No. 5,419,452 to Mueller, et al. provides trash can liner fasteners of several varieties, in order to retain the handles of a retailer provided take-home plastic bag. Mueller, et al. also teaches clips to fit over the edges of the trash container openings which will clamp the walls of the plastic bag as they pass over the edges of the opening.

U.S. Pat. No. 5,090,585 to Power teaches a trash can with an outer lip around its opening which cooperates with a plug to trap the sidewall of a plastic trash can liner.

U.S. Pat. No. 4,925,056 to McCoig teaches an adapter ring which suspends a trash can liner with handles or sidewall openings, within a trash receptacle.

Most of the variants taught by the above discussed references require that handles be provided on the trash can liner or plastic bag to be employed as a liner.

Other known means of attempting to prevent the container liner from falling into the container is by use of rubber bands to trap the sidewall overlying the outside of the trash container to the outside wall of the container, or by drawing the mouth of the liner tightly around the opening of the container and knotting the excess material of the liner upon itself to provide a snug frictional interface between the liner and the opening of the container.

SUMMARY OF THE INVENTION

An improved trash container is provided which includes a simple fastening device for retention of the edges of the trash can liner to the outside of a trash container.

The improved trash container is provided with one or more clasps having upwardly opening jaws, the clasps being fixed to the outer surface of the walls of the trash container. Once a liner has been placed into the interior of the trash container, the mouth of the liner is overlapped over the rim of the trash container and is drawn down the outer sidewall of the container. The jaws of the clasps can be manually opened and the edge of the mouth of the liner placed in the jaw whereupon the jaw is allowed to close, grasping the edge of the trash can liner and preventing the liner from falling into the interior of the trash container when trash is placed in the liner within the container. The clasps may be formed integrally upon the outer wall of the trash container, or the clasps may be mounted by adhesive or mechanical means to the outer wall of the container. In an alternative embodiment, the clasp may be retained to the outer wall of the container by a flexible strap or cord.

Accordingly, it is an object of the invention to provide a trash container having a simple and inexpensive grasping device to retain the edge of the mouth of a trash container liner placed within the trash container.

Another object of the invention is to provide a trash container having a plurality of integrally molded clasps which can be manually opened to receive the edge of the mouth of a trash container liner having flexible thin walls.

Another object of the invention is to provide a retainer for trash container liners which can be simply mounted to the outer surface of the sidewalls of a trash container to provide a retention means to hold the edge of the mouth of a trash container liner placed within the trash container.

Another object of the invention is to provide an improved trash container equipped with means to prevent slippage of an inserted liner into the container, the means also serving as a handle for the container.

These and other objects and features of the invention will be apparent from the detailed description which follows.

DESCRIPTION OF THE DRAWING FIGURES

DETAILED DESCRIPTION OF THE INVENTION

Figure 1:
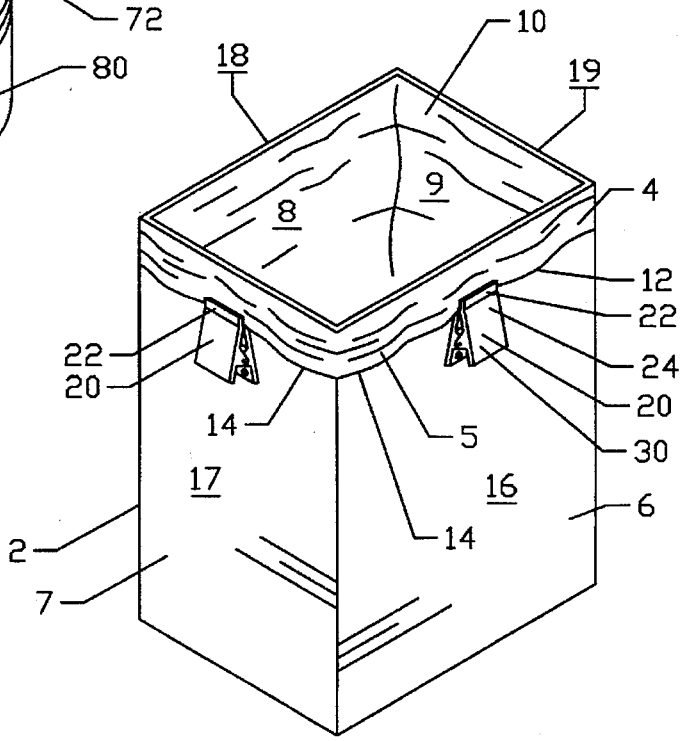
FIG. 1 is a front perspective of the preferred embodiment trash container having generally orthogonal sidewalls with a container liner placed therein and with the sides of the liner overlying the rim of the container and being grasped by the clasp members of the invention.
Figure 2:
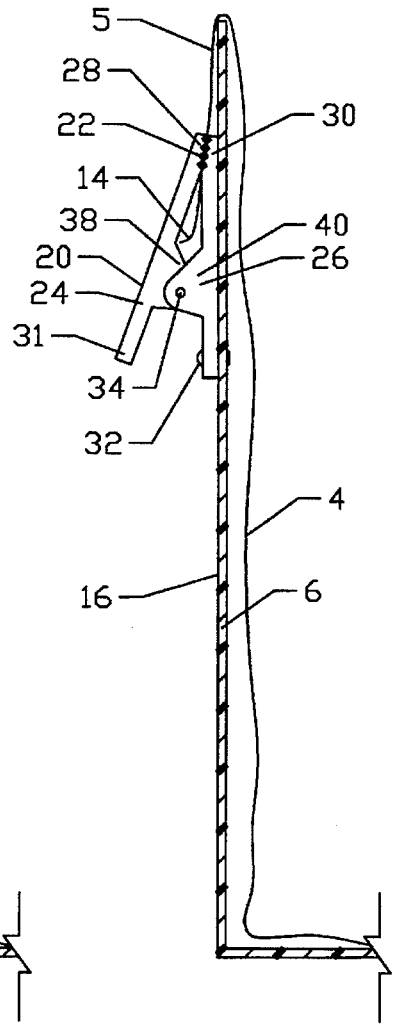
FIG. 2 is a view partly in section of a segment of the sidewall of the preferred embodiment trash container having a clasp member mounted to the sidewall of the trash container by rivet or other mechanical means.

Referring now to the drawings and in particular to FIGS. 1 and 2, the preferred embodiment trash container 2 is disclosed having expanded therein a liner 4 which is of the thin-walled polymeric variety as is commonly used by householders and industries alike to line trash containers to prevent deposit of detritus upon the inside of the container itself. Trash container 2 includes upstanding sidewalls 6, 7, 8 and 9 which are generally orthogonally interrelated and which define a rim about opening 10 at the upper ends thereof. Liner 4 is sized to approximate the volume of container 2 when liner 4 is expanded, wherein the mouth 12 of liner 4 is placed over the rim defined at the upper ends of sidewalls 6, 7, 8 and 9 such that the edges 14 of mouth 12 of liner 4 are drawn over the rim of container 4 and extend downward adjacent the outer surfaces 16, 17, 18 and 19 of sides 6, 7, 8 and 9 respectively.

Disposed upon outer surfaces 16 and 17 are clasp members 20 which are fixed to illustrated surfaces 16 and 17 and oriented such that the jaws 22 thereof are directed toward the opening 10 of container 2, which in the preferred embodiment illustrated in FIGS. 1 and 2 requires jaws 22 to be disposed upwardly. Jaws 22 may be opened by manipulation of clasps 20 and may receive and grasp the liner 4 along the region 5 thereof which overlies the outer surfaces 16 and 17. It is to be understood that clasps 20 must be positioned sufficiently near the tops of sidewalls 6 and 7 such that the liner 4 may rest on the inside of container 2 while segments of region 5 thereof are grasped by clasps 20. It is not intended that liner 4 be suspended above the bottom of container 2 by the action of clasps 20 but merely that clasps 20 exert resistance when objects are dropped or otherwise deposited into liner 4 in container 2.

Referring particularly to FIG. 2, the preferred embodiment clasp 20 is disclosed mounted mechanically to a sidewall 16 of container 2 which is shown partly cut away and with the sidewall 6 and liner 4 shown in section. Clasp 20 comprises a first element 24 interactive opposingly and movable upon second element 26, said first and second elements 24 and 26 being substantially identical. Jaw end 28 of first element 24 opposes jaw end 30 of second element 26, and first element 24 and second element 26 are biased such that jaw end 28 touchingly engages jaw end 30 when clasp 20 is at rest, there being provided spring means to cause jaws 22 to remain in closed position until forced open by application of force to handle end 31 of first element 24.

Clasp 20 is retained to sidewall 6 by rivet 32 which passes through second member 26 and through sidewall 6.

Referring again to FIG. 1, it can be visualized that clasps 20 are transversely dimensioned, such that sufficient width of first element 24 is provided for the handle end 32 thereof to function as a handle for container 2 to be lifted or carried, whether or not a liner 4 is stationed therewithin.

It can be understood that clasp 20 may be of the alligator clip type, with a pin 34 joining fulcra 38 and 40 of first element 24 and second element 26 respectively. It is seen in FIG. 2 that overlying region 5 of liner 4 is conveniently held within jaws 22 of clasp 20 until release thereof is desired and effectuated by the manual opening of jaws 22.

It is further to be understood that clasps 20 may be fixed to each of outer surfaces 16, 17, 18 and 19 but the invention container 2 will also function if only one clasp 20 is utilized on one of the sidewalls.

Figure 3:
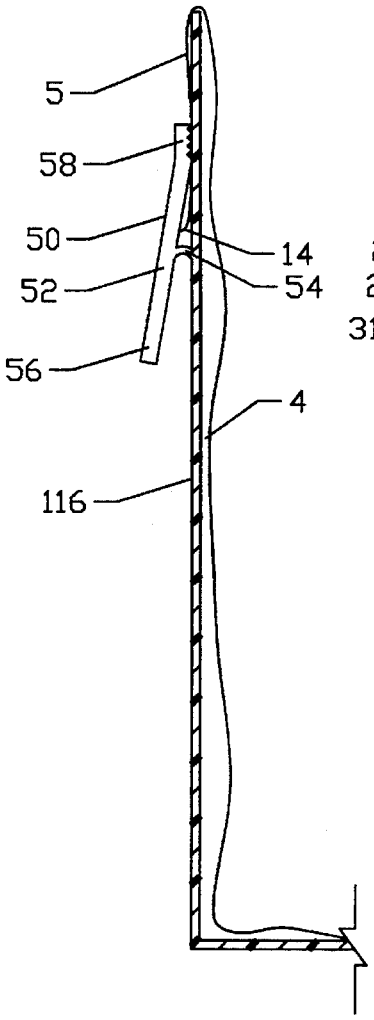
FIG. 3 is a close up view partly in section of the sidewall of an alternative embodiment trash container having the clasp member thereof integrally formed on the sidewall and retaining the edge of the mouth of a container liner which has been placed within the trash container.

FIG. 3 discloses an alternate embodiment of the container invention whereby a clamp 50 is integrally formed with the sidewall 116 of the alternate embodiment container of FIG. 3. Clamp 50 comprises a clamping element 52 joined by a formed hinge 54 to outer surface 116, hinge 54 having a curvilinear shape which is biased to be linear and serves to urge jaw end 58 of clamping element 52 into touching engagement with outer surface 116. The region 5 of liner 4 which extends over outside surface 116 may be inserted between jaw end 58 and outer surface 116 when a sideways force is applied toward lever end 56 in the direction of outer surface 116. As with the clasp 20 of FIG. 1, clamp 50 may be formed to be wide enough to serve as a handle for the container. The use of an integrally formed clamp 50 will allow very inexpensive manufacture of the container invention.

Figure 4:
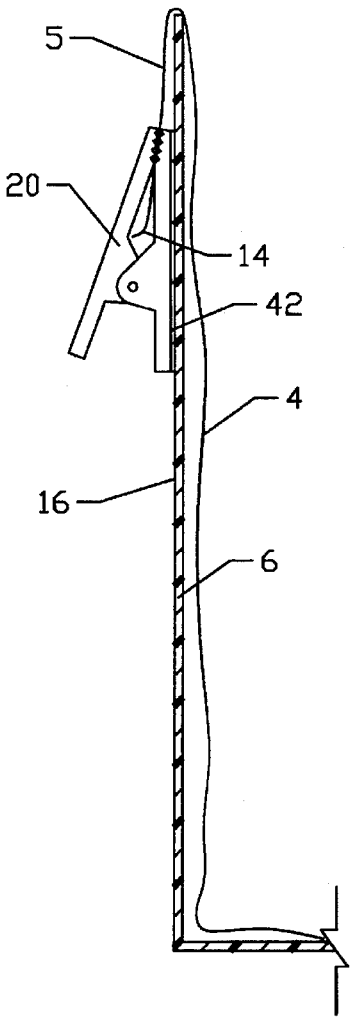
FIG. 4 is a view partly in section of a segment of the sidewall of another alternate embodiment trash container having the clasp member retained to the sidewall by double sided tape or adhesive means.

FIG. 4 depicts an alternate arrangement wherein the clasp 20 is retained to the outer surface 16 of sidewall 6 by adhesive means such as double sided adhesive tape 42. When clasp 20 is provided with double sided tape 42, it can be understood that clamp 20 may be easily applied to an existing container, thereby converting a container with no liner retention device to a container equipped with a clasp 20 which can grasp the edges 14 of liner 4 to prevent the liner from slipping down the inside wall of the container.

Figure 6:
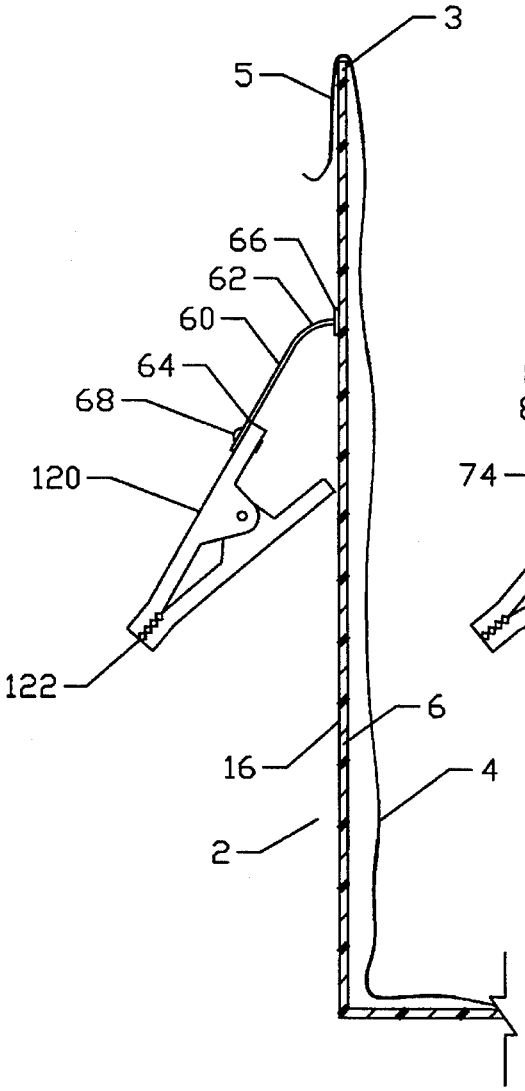
FIG. 6 is a view in section of a sidewall of another alternate embodiment trash container having a variation of the clasp member provided with an elongate strap element which is retained to the outside of the sidewall of the trash container.

FIG. 6 discloses an alternate embodiment of the trash container invention wherein a clip 120 is suspended from sidewall 6 by an elongate strap 60 having anchor end 62 and opposing clasp end 64. Anchor end 62 terminates in pad 66 which is secured to outer surface 16 of sidewall 6 by adhesive means. Clasp end 64 is fixed to clip 120 by rivet 68 or other satisfactory mechanical or adhesive means. Liner 4 is placed in the container 2 and region 5 thereof is drawn over the rim 3 of the container 2, whereupon clip 120 may be raised manually and clipped to the liner 4 by its jaws 122.

Figure 5:
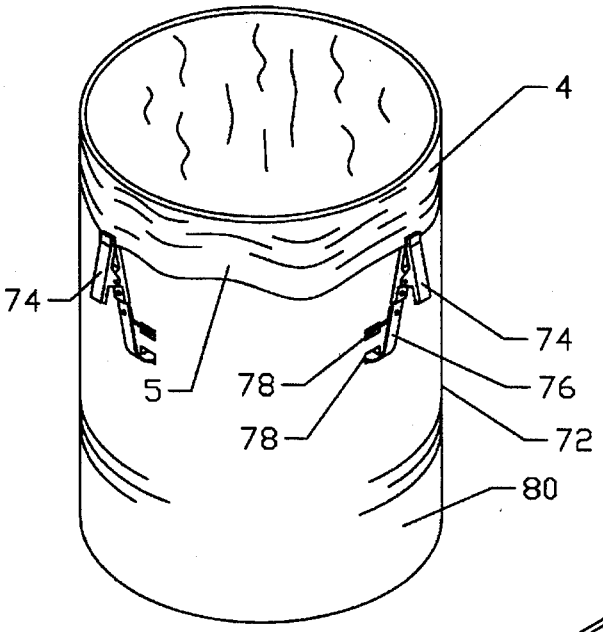
FIG. 5 is a front perspective of an alternative embodiment trash container which is generally cylindrical with a container liner placed therein and with the sides of the liner overlying the rim of the container and being grasped by clasp members of the invention.
Figure 7:
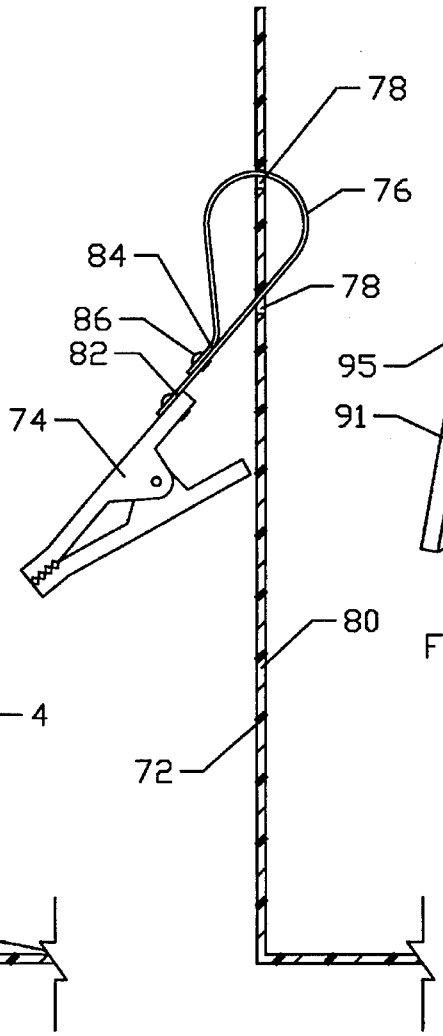
FIG. 7 is a view in section of a segment of sidewall of yet another alternate embodiment of the invention trash container, the sidewall having openings therein to receive a strap which is doubled back on itself and retained together at its ends, one end of the strap having a clasp extending therefrom.

Yet another embodiment of the trash can liner invention is disclosed in FIGS. 5 and 7 wherein a trash container 72 of generally cylindrical configuration is disclosed which has mounted thereto a multiplicity of liner retaining clips 74 which are fixed to belts 76 which pass through paired openings 78 in the sidewall 80 of container 72. The openings 78 of each pair are spaced apart a small distance, preferably from approximately 0.1 to 2.0 inches. Wider spacing may be used provided that belt 76 is of sufficient length. Each belt 76 is provided with a first end 82 which is fixed to clip 74 and with a second end 84 which is passed successively through each of paired slots 78 and turned back on itself and connected near first end 82 by snap 86 such that second end 84 is selectively detachable from its connection to belt 76. Hence, a container with no liner retention means may be modified by creating openings 78 through sidewall 80 and a clip 74 suspended on belt 76 added.

Figure 8:
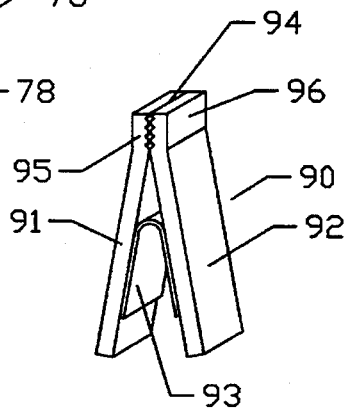
FIG. 8 is an enlarged perspective of an alternative embodiment clasp member illustrating an integral spring element formed as part of the clasp member.

FIG. 8 illustrates an advantageous alternative form of clasp 90 which may be formed of polymeric material, the clasp having first and second elements 91 and 92 joined by a curved flexible hinge 93, all of which are formed as a unit. Jaws 94 are formed by the cooperation of the toothed ends 95, 96 of first and second elements 91 and 92 respectively and are urged together by the hinge 93 which serves as a spring. Clasp 90 may be mounted by rivets or adhesives to a trash container sidewall with jaws 94 positioned upward such that jaws 94 may be opened to receive the edge of a liner placed within the container on which clasp 90 is fixed. It is to be noted that the width of clasp 90 may be sufficient for a person to use clasp 90 as lifting handle for the container.

While the foregoing description contains many specific structures, it is to be understood that the specific structures are merely exemplification of the preferred embodiment of the invention. Those skilled in the art will recognize that, for example, the containers may be made from metals or plastics of many varieties and that the clasps or clips may be constructed of metals or plastics or mixtures thereof. Further, the clips may be pincer-type clothespins or alligator clips mounted on short straps such as are frequently used to suspend employee badges from clothing of the wearer. Further, though the drawings illustrate rectangular and generally cylindrical trash containers provided with differing embodiments of the invention, other geometrical shapes of containers may be equally useful and may be equipped with any of the disclosed embodiments of clasp and clip structures. In addition, the containers may be fabricated with the clasps mounted thereto or formed thereon. Alternatively, the clasps may be obtained separately and employed on existing containers to convert them to the useful devices of this invention. Accordingly, the reader should determine the scope of the invention from the claims which follow and from their indubitably equivalent structures.

We claim:

1. A trash container for receiving a thin-walled flexible liner, the trash container having an open mouth, comprising an open topped generally rigid bin, the bin having a generally upstanding sidewall, the sidewall having an outer surface, the outside surface of said sidewall having at least one clasp member mounted thereto, the at least one clasp member having a pair of opposing jaws, said opposing jaws biased to remain in touching engagement therebetween, said at least one clasp member selectively operable to separate said jaws, said jaws disposed toward said open mouth of said container, whereby said jaws may grasp an edge of the liner overlying the outer surface of the sidewall.

2. The trash container of claim 1 wherein said at least one clasp member is integrally formed with said sidewall.

3. The trash container of claim 2 wherein said at least one clasp member having a movable elongate element, said elongate element having teeth along a first end thereof, said first end biased toward said outside surface, a curved hinge interconnecting said elongate element and said sidewall, said hinge integral with said elongate element and said sidewall.

4. The trash container of claim 1 wherein said clasp member is mounted to said sidewall by an elongated strap or cord disposed between said clasp member and said outer surface of said sidewall of said bin.

5. The trash container of claim 4 wherein said sidewalls are provided with a pair of spaced apart openings therethrough, said elongate strap or cord has opposing ends, one end thereof fixed to said clasp member, a second end of said strap or cord threaded through said openings in said sidewall, said second end of said strap or cord selectively fixable to said strap along the length thereof.

6. The trash container of claim 4 wherein said elongate strap or cord has opposing ends thereon, one of said opposing ends fixed to said clasp member, another of said opposing ends having a pad thereon, said pad fixed to said outer surface of said sidewall of said bin by adhesive means.

7. In a trash container having sidewalls and a bottom and having an open mouth surrounded by a rim defined by said sidewalls, with a flexible thin-walled liner receivable in said container, said liner having a mouth, with said mouth of said liner overlying the rim of said container and extending downwardly along said sidewalls, apparatus to retain the liner to said container comprising a clasp fixed to the outer surface of at least one of said sidewalls of said container, the clasp having a pair of opposing elements biased toward each other, said opposing elements defining a pair of jaws in touching engagement when at rest, said clasp operable to separate said pair of jaws to form a jaw opening, said jaw opening disposed toward said mouth of said container, said jaw opening capable of retaining a segment of said liner therein.

8. The apparatus of claim 7 wherein said clamp is integrally formed upon said at least one sidewall.

9. The apparatus of claim 7 wherein said clasp is mechanically fixed to the outer surface of said at least one sidewall.

10. The apparatus of claim 7 wherein an elongate strap is fixed to said clasp, said strap has two opposing ends, said clamp is fixed to a first end of said strap, the second of said ends of said strap is fixed to said at least one sidewall.

11. The apparatus of claim 7 wherein said clasp is of sufficient width to provide a handle for said container.

12. The apparatus of claim 7 wherein said container is provided with a multiplicity of clasps, at least one of the clasps mounted on each of at least two sidewalls of said container, each of said clasps having a pair of opposing elements biased toward each other, said opposing elements defining a pair of jaws in touching engagement when at rest, each of said clasps operable to separate said pair of jaws to form a jaw opening, the jaw opening of each of said clasps disposed toward said mouth of said container, said jaw opening of each of said clasps capable of receiving a segment of said liner therein.

13. The apparatus of claim 12 wherein each of said clasps is of sufficient width to provide a handle for said container.

14. Apparatus to mount to an open mouthed receptacle having a sidewall and provided with a thin-walled flexible liner therein, to prevent said liner from falling to the bottom of said receptacle, comprising a clamp having a jaw thereon, said jaw disposed toward said mouth of said receptacle, said clamp retained to said sidewall of said receptacle upon the outside thereof, said clamp operable to selectively open said jaw, said clamp biased to a closed position of said jaw.

15. The apparatus of claim 14 wherein said clamp is adhesively fixed to said sidewall.

16. The apparatus of claim 14 wherein said clamp is mechanically fixed to said receptacle sidewall.

17. The apparatus of claim 14 wherein an elongate flexible strap is fixed to said clamp said strap has two opposing ends, a first end of said strap is fixed to said clamp, the second of said ends of said strap is fixed to said receptacle sidewall.

18. The apparatus of claim 14 wherein said clamp comprises a pair of elongate members integrally formed with a curved hinge therebetween, each of said elongate members having an end with teeth formed thereon, the teeth of one of said elongate members opposing the teeth of the other elongate member, said hinge urging said teeth of each of said elongate member into touching engagement therebetween.

19. The apparatus of claim 15 wherein said clamp is fixed to said sidewall by double sided adhesive tape.

20. The apparatus of claim 17 wherein said receptacle has a sidewall, said sidewall has a pair of spaced apart openings therethrough, said strap is threaded through said pair of openings, said second end of said strap is doubled back upon itself and selectively fixed to itself along the length thereof.

* * * * *